US009187987B2

(12) United States Patent
Greene et al.

(10) Patent No.: US 9,187,987 B2
(45) Date of Patent: Nov. 17, 2015

(54) SYSTEM AND METHOD FOR CONTROLLING FLOW THROUGH A SAND SCREEN

(71) Applicant: SCHLUMBERGER TECHNOLOGY CORPORATION, Sugar Land, TX (US)

(72) Inventors: Robin Greene, Stavanger (NO); Terje Moen, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 136 days.

(21) Appl. No.: 13/646,862

(22) Filed: Oct. 8, 2012

(65) Prior Publication Data

US 2013/0092391 A1 Apr. 18, 2013

Related U.S. Application Data

(60) Provisional application No. 61/546,471, filed on Oct. 12, 2011.

(51) Int. Cl.
*E21B 43/08* (2006.01)
*E21B 43/12* (2006.01)

(52) U.S. Cl.
CPC ..... *E21B 43/08* (2013.01); *E21B 43/12* (2013.01)

(58) Field of Classification Search
USPC ..... 166/205, 227, 230, 231, 236, 373, 386
See application file for complete search history.

(56) References Cited

U.S. PATENT DOCUMENTS

| | | | | |
|---|---|---|---|---|
| 5,190,102 | A * | 3/1993 | Arterbury et al. | 166/228 |
| 5,435,393 | A | 7/1995 | Brekke et al. | |
| 5,730,223 | A | 3/1998 | Restarick et al. | |
| 6,745,843 | B2 | 6/2004 | Johnson et al. | |
| 7,469,743 | B2 | 12/2008 | Richards | |
| 7,559,375 | B2 | 7/2009 | Dybevik et al. | |
| 7,802,621 | B2 | 9/2010 | Richards et al. | |
| 7,832,473 | B2 | 11/2010 | Pensgaard | |
| 8,316,952 | B2 * | 11/2012 | Moen | 166/373 |
| 2006/0048942 | A1 | 3/2006 | Moen et al. | |
| 2007/0246407 | A1 | 10/2007 | Richards et al. | |
| 2008/0041582 | A1 | 2/2008 | Saetre et al. | |

(Continued)

OTHER PUBLICATIONS

International Search Report and Written Opinion of PCT Application No. PCT/US2011/031942, dated Nov. 21, 2011.

(Continued)

*Primary Examiner* — William P Neuder
(74) *Attorney, Agent, or Firm* — Patrick Traister; Brandon S. Clark

(57) ABSTRACT

A system and methodology utilizes a technique for filtering sand; distributing a flow of fluid; e.g. distributing an inflow of gas or condensate; and limiting the potential for erosion of completion components in a wellbore. The technique may be useful in production applications, but the technique also can be used in fluid injection applications, e.g. gas injection applications. The technique employs a base pipe and a sand screen surrounding the base pipe. The base pipe comprises a plurality of flow restriction openings of reduced size and deployed in a selected pattern along the base pipe. The size and arrangement of the flow restriction openings reduces the peak flux of radial fluid flow through the sand screen to a rate less than a sand screen erosion rate.

18 Claims, 4 Drawing Sheets

(56) References Cited

U.S. PATENT DOCUMENTS

| | | | |
|---|---|---|---|
| 2008/0169099 | A1 | 7/2008 | Pensgaard |
| 2008/0217001 | A1 | 9/2008 | Dybevik et al. |
| 2009/0120641 | A1 | 5/2009 | Yeh et al. |
| 2009/0133874 | A1 | 5/2009 | Dale et al. |
| 2010/0051262 | A1 | 3/2010 | Dusterhoft et al. |
| 2010/0122810 | A1 | 5/2010 | Langlais |
| 2011/0180258 | A1 | 7/2011 | Scott et al. |

OTHER PUBLICATIONS

Greene, R. and Moen, T., "The Impact of Annular Flows on High Rate Completions", SPE 151817, SPE International Symposium and Exhibition on Formation Damage Control, Feb. 2012: pp. 1-12.

PCT/US2012/059274, International Search Report and Written Opinion, Mar. 25, 2013.

* cited by examiner

SYSTEM AND METHOD FOR CONTROLLING FLOW THROUGH A SAND SCREEN

CROSS-REFERENCE TO RELATED APPLICATION

The present document is based on and claims priority to U.S. Provisional Application Ser. No. 61/546,471, filed Oct. 12, 2011, incorporated herein by reference.

BACKGROUND

In many gas wells, inflowing fluid passes through a sand screen which filters out particulates from the inflowing gas. Generally, the flow rate of the inflowing gas is very high such that any sand production can cause substantial erosion of components in a gas well completion. The sand production is controlled with sand screens employed either as stand-alone screens or in combination with a surrounding gravel pack. However, the velocity of the inflowing gas often can exceed an erosion velocity which causes erosion of the sand screen and ultimate failure of the sand screen. One scenario is the split in flow between the inside of the base pipe and annulus. The annular flow has to enter through the last screen joint, or eventually through screen joints sitting before annular packers. If this annular flow enters through a screen or part of a screen, erosion can be the result. Once the sand screen fails, the risk of erosion arises with respect to other elements of the completion. Use of gravel packing may limit the velocity of particulates; however gravel packs are not necessarily uniform along the entire sand screen, resulting in high, erosive flow rates through poorly packed regions.

SUMMARY

In general, a system and methodology is provided for filtering sand; distributing a flow of fluid; e.g. distributing an inflow of gas or condensate; and limiting the potential for erosion of completion components in a wellbore. By way of example, the technique is useful in production applications, but the technique also can be used in fluid injection applications, e.g. gas injection applications. The technique employs a base pipe and a sand screen surrounding the base pipe. The base pipe comprises a plurality of flow restriction openings of reduced size and deployed in a selected pattern along the base pipe. The size and arrangement of the flow restriction openings reduces the peak flux of radial fluid flow through the sand screen to a rate less than a sand screen erosion rate.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for filtering sand from flowing fluid, such as from inflowing gas in a gas production well. As explained in greater detail below, the system and methodology also enable a desired distribution of the flowing fluid across the sand screen while keeping the flow rate of the flowing fluid below an erosion flow rate to protect the sand screen from degradation.

According to an embodiment, a well system is provided with one or more sand screen assemblies coupled into a completion and deployed downhole into a well, e.g. a gas well. Each sand screen assembly comprises a base pipe surrounded by a sand screen which filters particulates from an inflowing stream of gas during gas production. The base pipe beneath the sand screen is equipped with a plurality of flow restriction elements through which the inflowing gas moves to an interior of the base pipe after passing through the sand screen. These flow restriction elements may be inserts of a variety of types, or they may be formed as holes, slits or other openings created through a wall of the pipe.

The flow restriction elements are sized and distributed to provide a controlled pressure drop and to remove regions of high flow velocity along the sand screen. The flow velocity is restricted to a rate below an erosion rate of the sand screen to prevent degradation and failure of the sand screen during gas production. The flow restriction elements may be arranged in a variety of patterns to provide the controlled pressure drop and thus the controlled flow rate through the sand screen. Patterns of the flow restriction elements may be selected to create a desired flow control, e.g. a desired variation in pressure drop and/or flow rate along the sand screen. Also, the design effectively controls flux through the sand screen in the event of an open annulus in the wellbore external to the sand screen.

In the case of a screen based completion with an open annulus outside of the screen, fluid may flow freely in and out of the screen (see description below with respect to the embodiment illustrated in FIG. 4). The free flow is enabled by the annulus outside of the screen forming another flow path for the fluid being produced below the subject screen. In high flow rate wells, the flow may become concentrated at, for example, a heel of the screen joint and this leads to high fluid velocity impinging the screen surface, thus creating a risk of screen erosion unless a suitable pattern of appropriately sized openings through the base pipe is provided.

Figure 1:
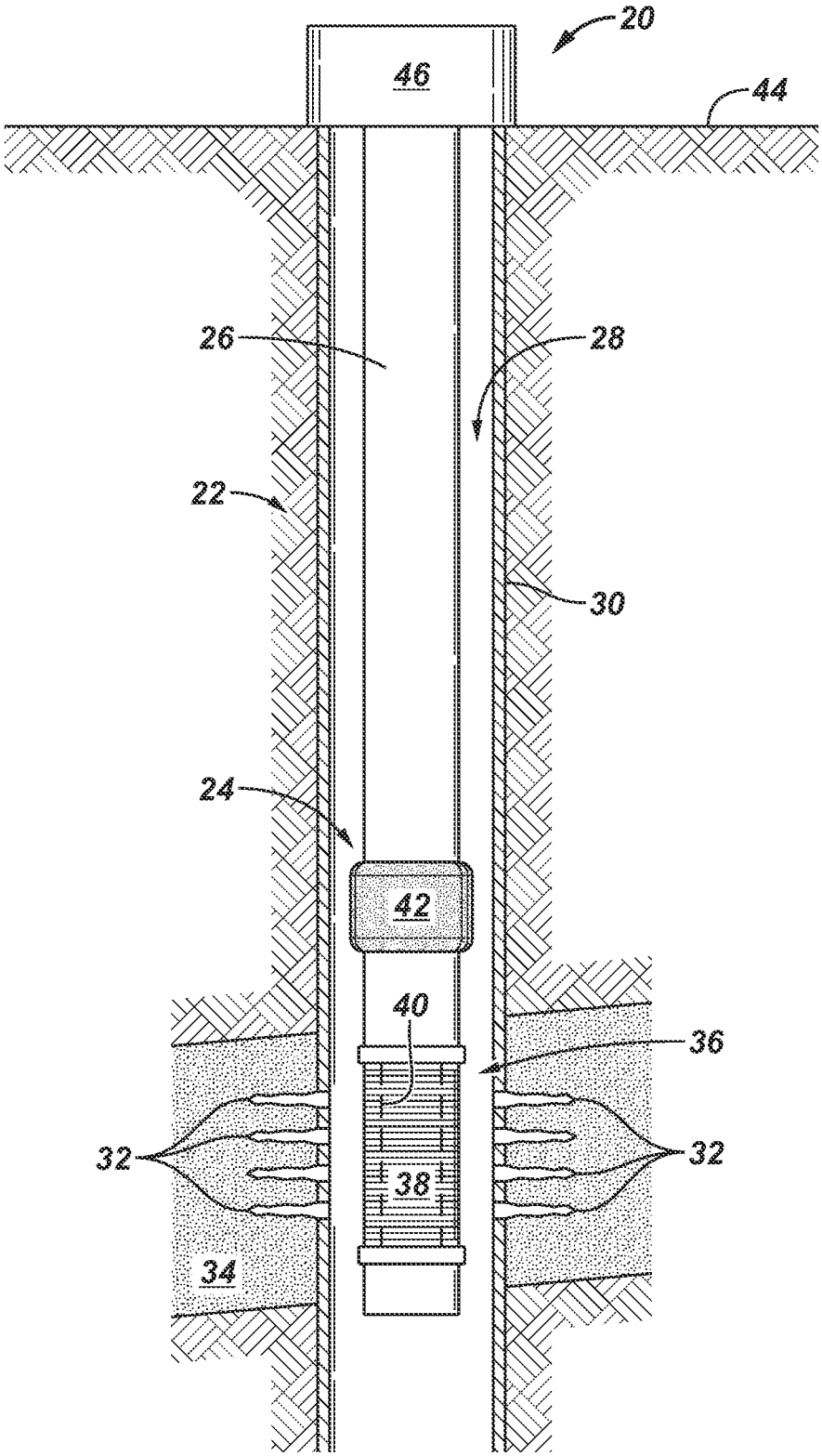
FIG. 1 is a schematic illustration of a well system comprising an example of a sand screen assembly deployed in a wellbore, according to an embodiment of the disclosure.

Referring generally to FIG. 1, an embodiment of a system, e.g. well system, for reducing erosion of a well screen is illustrated. By way of example, the well system may comprise many types of components and may be employed in many types of applications and environments, including cased wells and open-hole wells. The well system also may be utilized in vertical wells and deviated wells, e.g. horizontal wells. The system may utilize many types of sand screens in many types of production wells or other types of applications in a variety of environments.

Referring again to FIG. 1, one schematic example of a well system 20 for use in a well 22 is illustrated. Well 22 may comprise a production well for producing a desired fluid, e.g. gas or oil; or well 22 may comprise an injection well for injecting a desired fluid, e.g. gas or water. The well system 20 is designed to enable filtering of flowing fluid during production (or injection) of fluid from the well 22. In this particular example, well system 20 may comprise a well completion 24, e.g. a gas production well completion, deployed downhole into a wellbore of well 22. The completion 24 may be deployed downhole via a conveyance 26, such as coiled tubing, production tubing, or another suitable conveyance. Depending on the specific application, well 22 may comprise a wellbore 28 which is cased or lined with a casing 30 having perforations 32 to enable fluid communication between a surrounding reservoir/formation 34 and the wellbore 28. However, completion 24 may be employed in open wellbores or in a variety of other wellbores, environments and wellbore configurations designed to maximize retrieval of the desired hydrocarbon based fluid, e.g. gas. The completion 24 also may be designed for fluid, e.g. gas, injection applications.

Well completion 24 potentially includes many types of devices, components and systems. For example, the well equipment may comprise a variety of artificial lift systems, sensor systems, monitoring systems, and other components designed to facilitate production operations, servicing operations, and/or other well related operations. In the example illustrated, well completion 24 further comprises a sand screen assembly 36.

The sand screen assembly 36 has a sand screen 38 designed to filter sand from gas or other fluid flowing across the sand screen 38. During gas production, for example, gas flows into wellbore 28 from formation 34 and passes through sand screen 38 which filters out sand while allowing the remaining gas to pass into completion 24. The sand screen 38 may be used in cooperation with and/or be positioned between other components of the well completion 24. Additionally, the sand screen assembly 36 may comprise a base pipe 40 positioned such that the sand screen 38 is mounted to surround the base pipe 40.

Completion 24 also may comprise one or more isolation devices 42, e.g. packers, positioned to enable selective isolation of a specific well zone associated with the sand screen assembly 36. It should be noted that well completion 24 may further comprise additional sand control assemblies 36 and isolation devices 42 to isolate and control fluid flow, e.g. gas flow, from (or to) other well zones of the reservoir/formation 34.

In FIG. 1, wellbore 28 is illustrated as a generally vertical wellbore extending downwardly from a surface location 44. Additionally, completion 24 is illustrated as deployed downhole into the generally vertical wellbore 28 beneath surface equipment 46, such as a wellhead. However, the design of wellbore 28, surface equipment 46, and other components of well system 20 can be adapted to a variety of environments. For example, wellbore 28 may comprise a deviated, e.g. horizontal, wellbore or a multilateral wellbore extending from surface or subsea locations. The well completion equipment 24 also may be designed for deployment into a variety of vertical and deviated wellbores drilled in a variety of environments.

Figure 2:
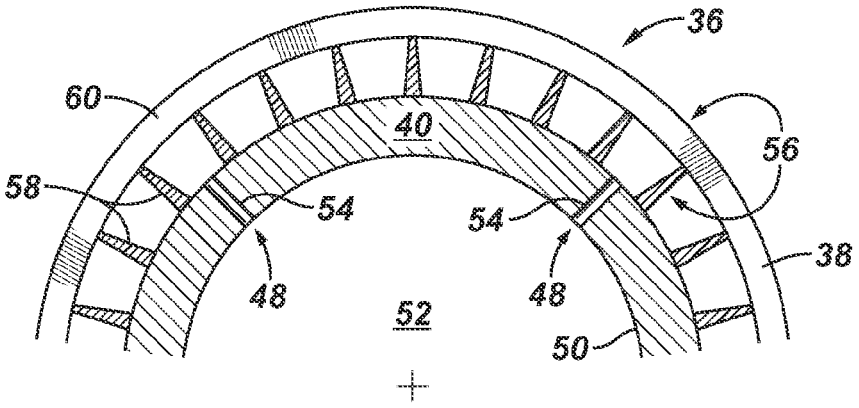
FIG. 2 is a partial cross-sectional view of an example of a sand screen assembly taken generally across an axis of the sand screen assembly, according to an embodiment of the disclosure.
Figure 3:
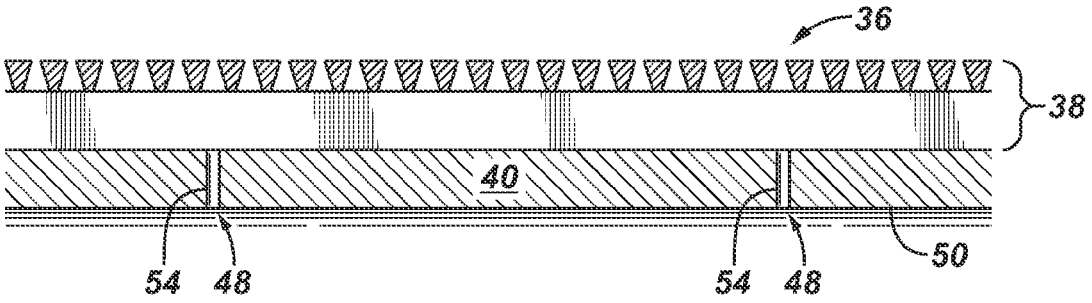
FIG. 3 is a partial cross-sectional view of an example of a sand screen assembly taken generally in an axial direction through a wall of the sand screen assembly, according to an embodiment of the disclosure.

Referring generally to FIGS. 2 and 3, an embodiment of sand screen assembly 36 is illustrated. In this embodiment, base pipe 40 comprises a plurality of flow restriction elements 48, and sand screen 38 is mounted around base pipe 40 and the plurality of flow restriction elements 48. The flow restriction elements 48 are designed to allow gas flow through a sidewall 50 of base pipe 40 and into an interior 52 of the base pipe for production to a desired location. The flow restriction elements 48 are arranged in a desired, predetermined pattern to provide a controlled pressure drop across the base pipe 40, and thereby to provide a controlled flow rate of inflowing gas through sand screen 38. The flow restriction elements 48 also may be employed for use with other fluid, e.g. condensates, oil or water, flowing at a high flow rate into or out of the base pipe 40 during production or injection applications.

The flow restriction elements 48 are distributed along the base pipe 40 in a desired pattern to create a controlled flow of fluid in a radial direction through the sand screen 38. The distribution of the restriction elements 48 is selected to reduce a peak flux through the screen and to create a distributed inflow of fluid that is below an erosion flow rate along the screen, e.g. along the entire surface area of the sand screen 38. By way of example, the flow restriction elements 48 may comprise small holes or orifices 54 extending in a generally radial direction through sidewall 50 of base pipe 40. The orifices 54 have a diameter selected according to the parameters of the downhole application, e.g. gas production application, so as to sufficiently reduce the rate of flowing fluid below an erosion rate of sand screen 38. In some applications, the flow restriction elements 48 may be nozzles in the form of nozzle inserts each having an opening 54 with an increasing diameter along the direction of fluid flow. The size and/or concentration of orifices 54/restriction elements 48 may be adjusted to change the perforation density along the length (e.g. along the full length) of the base pipe 40 to optimize a flow distribution pattern.

The inflow area provided by flow restriction elements 48 is a function of perforation/orifice diameter and the number of orifices 54. To achieve an even distribution of the flowing fluid, e.g. inflowing gas, as desired in some embodiments, small holes may be created through sidewall 50 of base pipe 40 in a consistent or even pattern. This type of pattern through the base pipe 40 creates an even gas inflow pattern toward and through the sand screen 38. In the embodiment illustrated, sand screen 38 also comprises a plurality of layers 56 designed to facilitate both filtering and flow through the sand screen 38. Depending on the well environment and other downhole factors, the actual type and number of layers can vary substantially. However, several types of sand screens 38 comprise an internal drainage layer 58 surrounded by a filter media layer 60. Other and/or additional layers also may be provided. In some applications, the openings 54 are one to five times the size of the slot openings through the sand screen 38.

Figure 4:
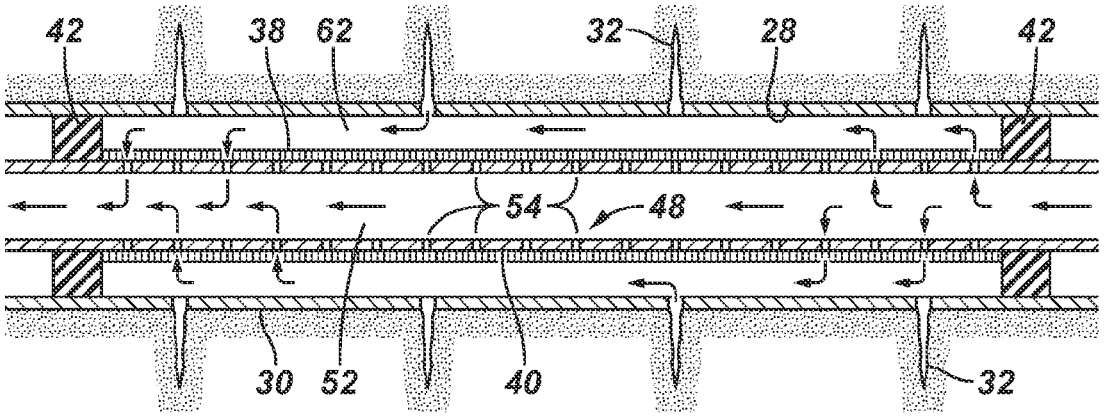
FIG. 4 is a schematic illustration of an example of a sand screen located in a wellbore and constructed to control radial and axial flow to reduce or prevent erosion, according to an embodiment of the disclosure.

Referring generally to FIG. 4, a screen based completion is illustrated in a horizontal wellbore 28 with an open annulus 62 outside of the sand screen 38. In this example, fluid may flow relatively freely in and out of the sand screen 38. This is driven by the fact that the annulus 62 outside of the sand screen 38 is forming a flow path for the fluid being produced below the current screen. When not considering any radial flow contribution from the well, the pressure loss along a joint of a conventional screen with normal perforation density is the same both inside and outside of the screen joint. This means that the distribution of flow between the inside of the pipe and outside in the annulus is driven by geometric factors. As an example, a small base pipe and a large annulus will allow for a relatively larger fraction of the total fluid flow to pass through the annulus. Even if annular packers are used between different screen joints, this split between flow in the annulus and inside of the base pipe will to a large extent be established. As this annular flow approaches the heel of the well or any open hole packer or similar flow barrier in the annulus, the fluid in the annulus is forced to enter the screen again.

The same effect also can be observed in the case of a gravel pack if voids are left in the gravel pack. In the case of a radial flow contribution from the reservoir, the amount of fluid entering into the annulus may be reduced according to the contribution from the reservoir, but still a relatively large fraction enters the screen from the annulus. When looking at common screen and well geometries, the amount of fluid flowing in the annulus may be in the range 10-50% of the total flow passing a given screen joint. In high flow rate wells, this leads to high fluid velocity impinging the screen surface and a risk of screen erosion. In the example illustrated in FIG. 4, however, the size and distribution of flow restriction elements 48 is predetermined to control the flux of fluid flowing radially through the sand screen 38. For example, the size and distribution of the flow restriction elements 48, e.g. openings 54, may be arranged to distribute the flux of radially flowing fluid over a greater region of the sand screen 38 and to thus avoid concentrated regions of flux that can lead to erosion of the sand screen 38.

Figure 5:
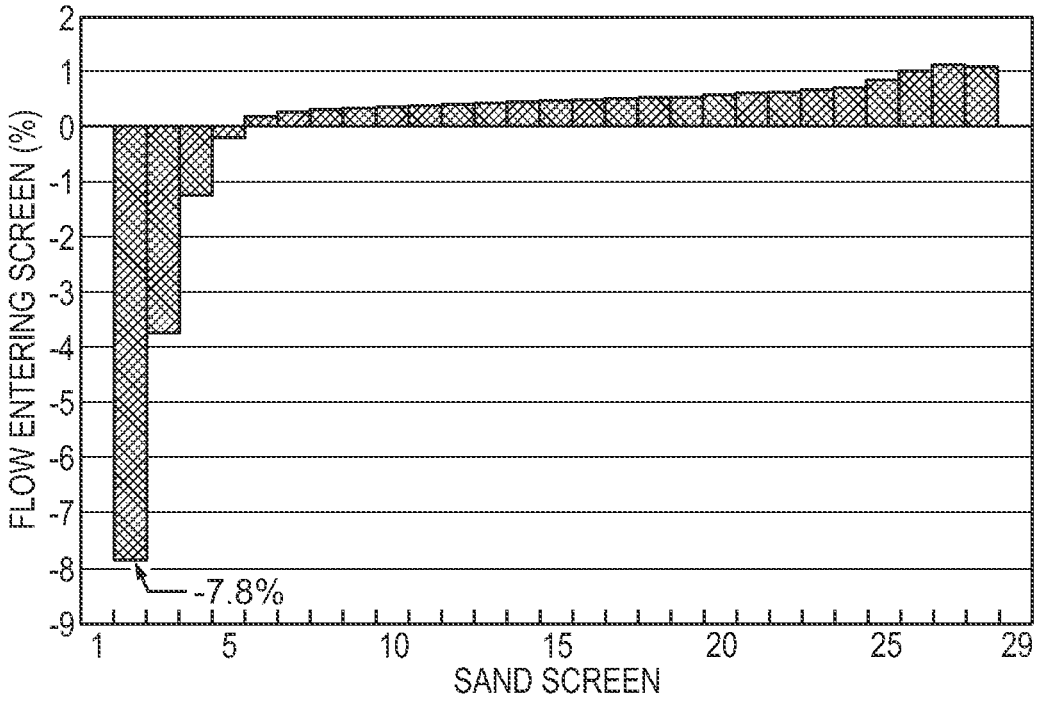
FIG. 5 is a schematic illustration of radial flux through a screen which does not comprise a distributed pattern of openings having a desired, reduced size, according to an embodiment of the disclosure.

Development of a split in flow between the inside of the base pipe and the annulus is controlled by the pressure drop along the length of the screen section within an open annulus and the radial pressure drop through the screen. In a standard sand screen, the perforation area often is in the range 1-5% of the base pipe area covered by the screen. When comparing the pressure drop along the length of the pipe and the radial pressure drop of a given amount of fluid entering a fraction of the screen, these two pressure drops will be in the same order of magnitude. This means if the base pipe inflow area is large; a given amount of fluid flowing in the annulus can enter the screen over a very short section. For example, the majority of the fluid can enter a screen length equal to a couple of screen diameters, as illustrated in the graphical example provided in FIG. 5. In some environments, the fluid can enter the screen over an even shorter length if the inflow area is large. As a consequence, the inflowing fluid enters the screen at a high fluid velocity and impinges the screen surface in a manner which creates a high risk of screen erosion.

To reduce the high velocity fluid flow impinging a small part of the sand screen 38, the system and methodology described herein create a controlled distribution of the inflowing fluid across a greater region of the sand screen 38, e.g. across the entire sand screen 38. By replacing a conventional perforation pattern and perforation diameter and using a plurality of flow restriction elements 48, a controlled pressure drop is developed. This controlled pressure drop forces the radial flow of fluid through the screen to be distributed over a larger area. When considering the same total flow in the well, the peak velocity impinging the screen surface can be reduced and, as a result, erosion risk also is reduced or even completely mitigated.

When using a conventional perforation pattern and a perforation diameter that may be in the range of 10 mm or more, a high flux through a small fraction is observed. If the hole diameter of openings 54 is reduced to 8 mm, for example, the pressure drop for the same flow rate is substantially greater and thus the flux is distributed over more area to reduce the erosion risk. By way of further example, if the hole diameter of openings 54 is reduced to 5 mm from 10 mm, the total perforation area is reduced 4 times. In the case of a high rate well, the flow through the perforations will be in turbulent mode. This means the pressure drop may be similar to that of a nozzle or an orifice, i.e. proportional to velocity squared. Consequently, a reduction from 10 mm to 5 mm hole diameter results in approximately 16 times higher pressure drop for the same flow rate. As the fluid can flow freely in the annulus, the flux will instead be distributed over a larger area and thereby reduce the erosion risk. Additionally, the openings 54 may be distributed uniformly along base pipe 40, or they may be arranged in specific patterns or densities to create a desired distribution of flux along the sand screen 38.

For example, various sizes, densities and patterns of flow restriction elements 48 may be located along the base pipe 40, and based pipe 40 may be positioned radially beneath the surrounding sand screen 38. The sizes, densities and patterns of flow restriction elements 48 also are selected according to the environment, downhole pressures, quality of the formation, presence of a surrounding gravel pack, and other environmental parameters. The size (e.g. 5 mm diameter or less), density and arrangement of the flow restriction elements 48 establish the desired pressure drop along the base pipe 40 and also serve to sufficiently reduce the flow velocity of the gas or other fluid below an erosion flow rate. In specific applications, the arrangement of flow restriction elements 48 is selected to reduce the flow rate of inflowing gas (and particulates carried with the inflowing gas) to a rate which does not cause erosion along any region of the surrounding sand screen 38. In many applications, the flow restriction elements 48 are evenly distributed along the base pipe 40, but the pattern also may be selected to optimally balance the out and in flow effect. Particularly, more restrictive elements 48 may be used in the section of the screen being exposed to the highest radial flow.

Figure 6:
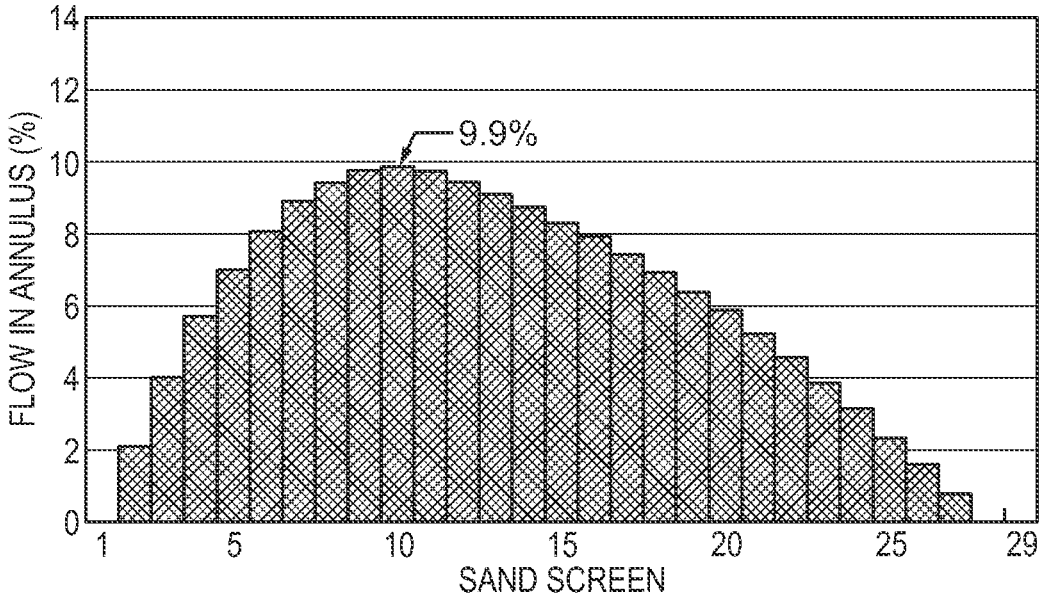
FIG. 6 is a schematic illustration of an example showing fractions of flow in the annulus along a sand screen at each section of the sand screen when flow through the sand screen is controlled by a suitable distributed pattern of openings having a desired, reduced size, according to an embodiment of the disclosure.

When smaller openings 54 are employed along the base pipe 40, an improved flow distribution pattern is provided, as illustrated graphically in FIG. 6. The diagram in FIG. 6 illustrates the fraction of fluid flow in the annulus 62 at a plurality of sections along the sand screen 38. The diagram shows the flow along the annulus 62 is better distributed than without the small openings and predetermined pattern. Consequently, the fraction of fluid flow entering radially through sand screen 38 is more uniformly distributed along the sections of the sand screen 38, as illustrated graphically in FIG. 7. In other words, the peak flux that would otherwise occur through the sand screen is substantially reduced to remove or at least reduce the risk of erosion due to high velocity flow in a radial direction through the sand screen 38.

Figure 7:
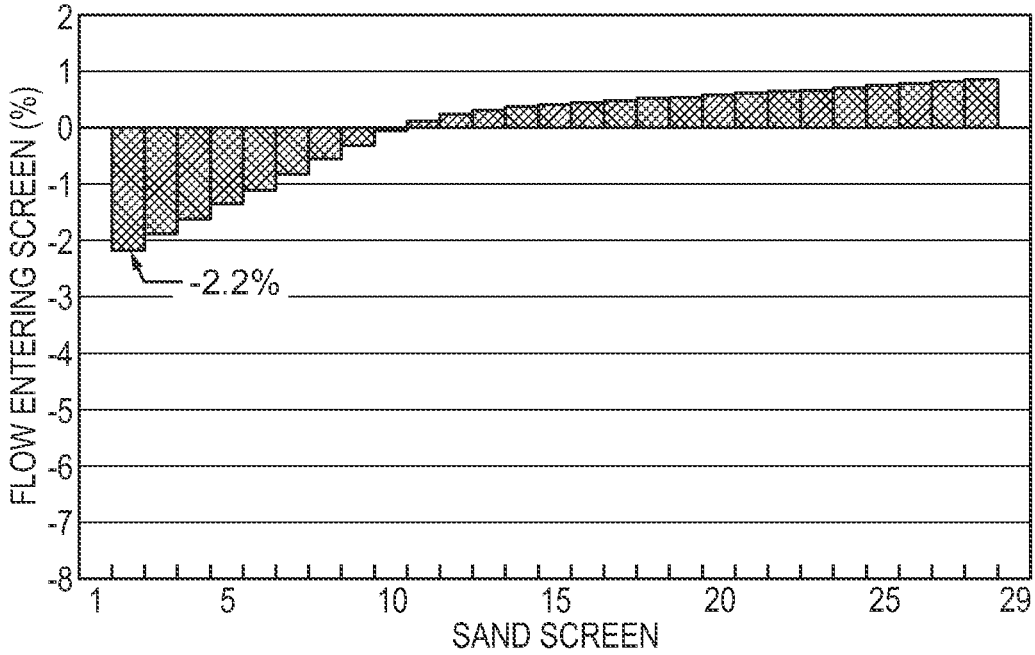
FIG. 7 is a schematic illustration of an example showing fractions of flow entering each screen section radially when flow through the sand screen is controlled by a suitable distributed pattern of openings having a desired, reduced size, according to an embodiment of the disclosure.

In the examples illustrated in FIGS. 6 and 7, the openings 54 were sized at approximately 5 mm in diameter along the base pipe 40 and this created slightly less flow entering the annulus 62 and also a distribution of flux across a larger surface area. For example, with 10 mm perforations, the fraction of fluid entering the last or heel section of the sand screen 38 was 7.8% (see FIG. 5) but the 5 mm perforations reduced the fluid flow through this last section to 2.2%, as illustrated in FIG. 7. The reduced size and the pattern of openings 54 maintain the peak velocity of the radially inflowing fluid below an erosion threshold even when substantial radial contributions of well fluid are received radially from the surrounding reservoir.

In some applications, the construction of sand screen 38, including the height of the drainage layer 58 and the shape of the wrapping wire, can be related to controlling flux. For example, a wire wrapped type screen may be constructed with a relatively wide wrapping wire combined with a tall axial wire. The combination of wires and wire sizes can be used to further help distribute the fluid flow over a relatively large area. As result, the peak velocity approaching the surface of the sand screen 38 is further reduced or otherwise controlled.

The reduced size openings 54 and the distribution of those openings along base pipe 40 can be used in a wide variety of screens and other types of inflow control devices to control localized screen flux along the length of the sand screen 38 without adding a large pressure drop to the overall completion assembly and without creating undesirable hotspots having high fluid flux. This methodology is contrary to existing techniques which maximize screen perforation density to minimize the average screen flux velocity.

Figure 8:
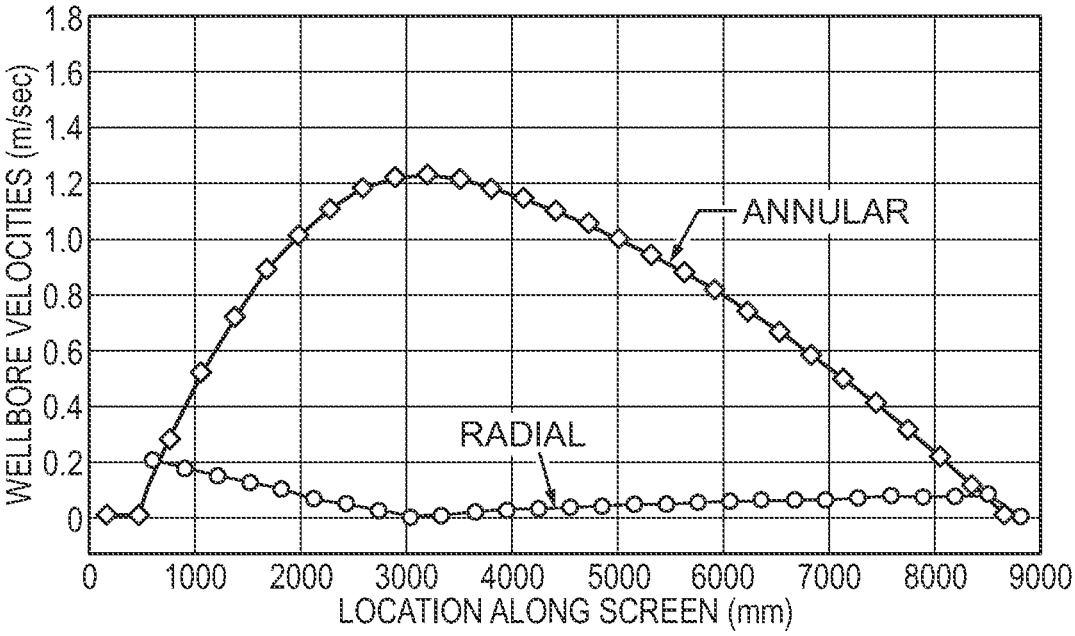
FIG. 8 is a schematic illustration of an example showing annular and peak radial velocity components of the sand screen when flow through the sand screen is controlled by a suitable distributed pattern of openings having a desired, reduced size, according to an embodiment of the disclosure.

As illustrated graphically in FIG. 8, the reduced opening size and the distribution of openings 54 maintains a low velocity of radial fluid flow through the sand screen 38 along the overall screen. Additionally, the distance between peak radial screen velocity and peak annular velocity is substantially increased which also increases the longevity of the sand screen 38. Use of the distributed, smaller openings 54 separates high annular velocity fluid from high radial velocity fluid, thus decreasing the probability of the high rate annular flow carrying erosive solids to the screen surface. If particles are not carried to the sand screen 38, then those particles are prevented from establishing an erosion risk. Solid particle transport is dependent upon fluid viscosity, density, particle density, and fluid velocity, and the size and distribution of openings 54 along sand screen 38 prevent hotspots of high fluid velocity in a radial direction.

Effectively, the smaller, distributed pattern of flow restriction elements 48 in the base pipe 40 locally chokes back the velocity of fluid entering the sand screen 38 without affecting the productivity capability of the overall completion. The level of peak velocity control applied can be tuned through analysis and parametric design of the distributed flow system to provide a controlled peak radial velocity for a given production rate. A distributed system of small openings 54 also separates any peak annular flows from the peak radial flows to reduce the probability of erosive particle entrainment. The small opening size and distributed pattern of openings also enables the production rate of a well to be set at a higher level than available when using a standard sand screen assembly in the well completion. Additionally, production rates can be kept at a higher level over the lifetime of the well.

The overall well system 20 may be constructed to accommodate a variety of flow filtering applications in a variety of well environments while limiting or preventing erosion of the screen and other completion components. Accordingly, the number, type and configuration of components and systems within the overall system may be adjusted to accommodate different applications. For example, the size, number and configuration of the sand screen assemblies may vary from one application to another along the completion equipment.

Additionally, many types of flow restriction elements and arrangements of those elements may be employed as dictated by the overall design of gas production equipment and by downhole environmental conditions. The size of the opening in each flow restriction element also may be adjusted according to the environment and parameters of a given application. In some applications, for example, the size of the openings may be set to approximately an average diameter of 8 mm or less. In other applications, the average diameter of the openings may be 5 mm or less as discussed with respect to embodiments described above. With respect to certain embodiments, the openings 54 may be round with a constant diameter while other embodiments may utilize out-of-round openings with each opening having an average diameter equal or less than the desired size, e.g. 5 mm.

The base pipe configuration and the sand screen configuration also may be adjusted according to the specific application and environment. The sand screen assemblies and their erosion control elements may be combined into many types of well completions utilized in production and/or servicing operations. Also, the types and arrangements of other downhole equipment used in conjunction with the one or more sand screen assemblies may be selected according to the specific well related application in which the sand screen assemblies are employed.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of preventing component erosion in a well, comprising:

forming a base pipe with a plurality of flow restriction openings extending radially therethrough;

limiting the average diameter of each flow restriction opening to 8 mm or less;

placing a screen around the base pipe to filter particulates from an inflowing fluid stream;

spacing the plurality of flow restriction openings along the base pipe to reduce a peak flux through the screen and to create a distributed inflow of fluid which maintains a flow rate of the inflowing fluid below an erosion flow rate across the screen; and varying perforation density along a length of the base pipe to optimize a flow distribution pattern by varying the sizes of flow restriction openings along the base pipe, the varying perforation density providing a relatively greater restriction of flow in sections of the screen otherwise exposed to the highest radial flow of fluid through the screen.

2. The method as recited in claim 1, wherein forming comprises forming the plurality of flow restriction elements as nozzles positioned in a sidewall of the base pipe.

3. The method as recited in claim 1, wherein limiting comprises limiting the average diameter of each flow restriction opening to 5 mm or less and wherein forming comprises forming the plurality of flow restriction openings with a size one to five times the size of slot openings through the screen.

4. The method as recited in claim 1, wherein spacing comprises spacing the plurality of flow restriction elements evenly along the base pipe to provide a controlled, constant pressure drop along the base pipe.

5. The method as recited in claim 2, further comprising forming the nozzles as nozzle inserts with each nozzle insert having an opening with an increasing diameter along the direction of fluid flow.

6. The method as recited in claim 1, further comprising forming the screen with a drainage layer positioned adjacent to the base pipe.

7. A method of preventing component erosion in a wellbore, comprising:

forming a sand screen assembly with a base pipe mounted within a sand screen;

providing a pattern of flow restriction openings along the base pipe;

arranging the pattern of flow restriction openings to control the flux of fluid flowing radially through the sand screen by distributing the flux of fluid over a greater region of the sand screen;

varying perforation density along a length of the base pipe to optimize a flow distribution pattern by changing the concentration of flow restriction openings along the base pipe, the optimization of the fluid distribution pattern comprising providing a relatively greater restriction of flow in sections of the sand screen otherwise exposed to the highest radial flow of fluid through the sand screen; and deploying the sand screen assembly downhole into a well.

8. The method as recited in claim 7, wherein providing comprises providing a pattern of nozzles positioned in a side wall of the base pipe.

9. The method as recited in claim 7, wherein providing comprises providing a pattern of openings having a diameter of 8 mm or less and positioned through a side wall of the base pipe to control flux in the event of an open annulus along the wellbore.

10. The method as recited in claim 7, further comprising producing a gas through the sand screen assembly.

11. The method as recited in claim 7, further comprising flowing a condensate through the sand screen assembly.

12. The method as recited in claim 7, further comprising producing an oil through the sand screen assembly.

13. The method as recited in claim 7, further comprising injecting a fluid through the sand screen assembly.

14. A system for use in a wellbore, comprising:

a base pipe having a plurality of distributed, flow restriction openings extending from an exterior to an interior of the base pipe, each opening having an average diameter of 5 mm or less to reduce peak flux of radial fluid flow; and a sand screen positioned around the base pipe to filter particulates from a flowing fluid stream, the plurality of distributed, flow restriction openings being located in a desired pattern along the base pipe to further reduce peak flux of radial fluid flow through the sand screen to a rate less than a sand screen erosion rate, the desired pattern being selected to vary the density of the distributed, flow restriction openings by varying the size and concentration of the distributed, flow restriction openings along the base pipe, the density being varied to provide a relatively greater restriction of flow in sections of the sand screen otherwise exposed to the highest radial flow of fluid through the sand screen.

15. The system as recited in claim 14, wherein the plurality of distributed, flow restriction openings comprises a plurality of orifices.

16. The system as recited in claim 14, wherein the plurality of distributed, flow restriction openings comprises a plurality of circular orifices.

17. The system as recited in claim 14, wherein the desired pattern provides an even distribution of inflowing gas across the sand screen and establishes a controlled pressure drop across the base pipe.

18. The system as recited in claim 14, wherein the flow of gas through a plurality of screen openings of the sand screen provides a small pressure drop in the same order of magnitude as the pressure drop along an exterior of the base pipe between distant flow restriction elements.

* * * * *